United States Patent [19]

Von Gunten

[11] 4,367,416

[45] Jan. 4, 1983

[54] RANDOM ELECTRIC TIMER HAVING A REVERSIBLE MOTOR

[76] Inventor: Lee L. Von Gunten, 1515 E. Crabtree, Arlington Heights, Ill. 60004

[21] Appl. No.: 369,154

[22] Filed: Apr. 16, 1982

Related U.S. Application Data

[63] Continuation-in-part of Ser. No. 10,501, Feb. 8, 1979, abandoned.

[51] Int. Cl.[3] ..... H01H 43/18; H01H 43/30

[52] U.S. Cl. ..... 307/132 R; 200/38 DA

[58] Field of Search ..... 307/132, 141; 200/35 R, 200/38 R, 38 B, 38 D, 38 DA, 38 CA, 38 DC

[56] References Cited

U.S. PATENT DOCUMENTS

| | | | |
|---|---|---|---|
| 3,155,848 | 11/1964 | Burford | 307/132 M X |
| 3,750,132 | 7/1973 | Natter | 200/38 D X |
| 3,925,629 | 12/1975 | Albinger | 200/38 DA X |
| 3,935,404 | 1/1976 | Persson | 200/35 R |
| 3,937,910 | 2/1976 | Fukami | 200/35 R |
| 4,029,918 | 6/1977 | Kah | 200/38 D |

*Primary Examiner*—Donald A. Griffin

*Attorney, Agent, or Firm*—Oldham, Oldham, Hudak & Weber Co.

[57] ABSTRACT

A random timer including a reversible electric drive motor, an output means, and a power circuit connecting a power supply to the drive motor and output means and where two dissimilar cam type timing elements are controlled by the drive motor to provide irregular non-continuous operative phases of output energy, and the power circuit of the motor includes a switch which is opened temporarily by each power phase actuation of the timing elements to provide an opportunity for the drive motor to reverse and change the timer cycle.

10 Claims, 7 Drawing Figures

RANDOM ELECTRIC TIMER HAVING A REVERSIBLE MOTOR

CROSS-REFERENCE

The present application is a continuation-in-part application of my prior application, U.S. Ser. No. 010,501 filed Feb. 8, 1979 and now abandoned.

BACKGROUND OF INVENTION

At the present, various types of automatic timers are in wide use in many households as well as in industrial installations. These timers are used for a variety of purposes, but an extensive commercial usage has developed for timers in homes for turning night lights on and off and for, in general, indicating that the home is inhabited even though it is vacant at such time. These automatic timers are believed to be effective in deterring criminals from breaking into the homes, but most of the timers now available are subject to the fault or problem that they operate at exactly the same time on a 24 hour cycle basis so that if a person is observing the house, such cyclical nature of the actuation of the lights in the home might well be observed. Hence, a potential burglar might see that the house was unoccupied and that some automatic power supply unit was present to provide the illusion of home occupancy.

Various patents have been proposed heretofore on different types of timer constructions and some of them include U.S. Pat. Nos. 3,823,280; 3,977,742; 4,029,918 and 3,925,629 as being typical examples of prior timer constructions. Yet another timer switch assembly is shown in U.S. Pat. No. 3,935,404 wherein the assembly utilizes a motor coupled to a randomizing drive element which is periodically disconnected from the motor and switch at fixed time intervals and permitted to rotate to a random position. This controls the interval between switch closing and opening and to make the same random. Seemingly, no control exists in the person designing the timer to know exactly what types of timing cycles will be provided by a particular unit.

OBJECTS OF INVENTION

It is the general object of the present invention to provide a truly random timing device characterized by the presence of two timing elements having dissimilar cycles and operably interconnected to control the output cycle of the timer; and to provide the unit with a device in the motor circuit for interrupting the power supply to the AC drive motor which will operate in either direction on each motor start depending on the power supply cycle.

Another object of the invention is to provide a relatively simple electro-mechanical unit that is made from uncomplicated, inexpensive but dependable members including light weight plastic gears connected to a reversible AC motor whereby a timer device is provided controlled by two shafts driven at different speeds in the timer.

Yet another object of the invention is to provide a random timer device utilizing a drive motor and two output cams having irregular and/or dissimilar timing characteristics and wherein the power output is interrupted when either one of the irregularly driven cam members is moved to an actuated position; and wherein the two dissimilar timing elements are connected in parallel in the power circuit, in effect, and where either timing element in an actuated position will prevent output from the timer unit; and to interrupt power to a drive motor temporarily with each actuation break in the power output.

Another object of the invention is to provide a durable, inexpensive, low power motor adapted to be used on either of two driving power cycles and to operate efficiently and with minimum heat development under each of the power cycles by means of an uncomplicated adjustment in the motor.

The foregoing and other objects and advantages of the invention will be made more apparent as the specification proceeds.

Attention is now particularly directed to the accompanying drawings, wherein.

When referring to corresponding members shown in the drawings and referred to in the specification, corresponding numerals are used to facilitate comparison therebetween.

SUBJECT MATTER OF INVENTION

The random timer of the invention, as one embodiment thereof, includes a bi-directional drive AC motor, an output means, and a power circuit connecting a power supply to the drive motor and output means, and wherein two dissimilar cam-type timing elements are controlled by the drive motor to provide irregular non-continuous operative pulses of output energy, and wherein each cam-type timing element includes an individual output shaft driven at a different speed from that of the timing element, a control member actuatable, intermittently, by either of the cam-type timing elements and connecting to a control switch for opening the same temporarily with each actuation by the timing elements to provide an interruption to the power output and to interrupt power supply to the drive motor to provide it with an opportunity for reversing and changing the control action of the cam-type timing elements.

DIAGRAMMATIC CIRCUIT DESCRIPTION

Figure 1:
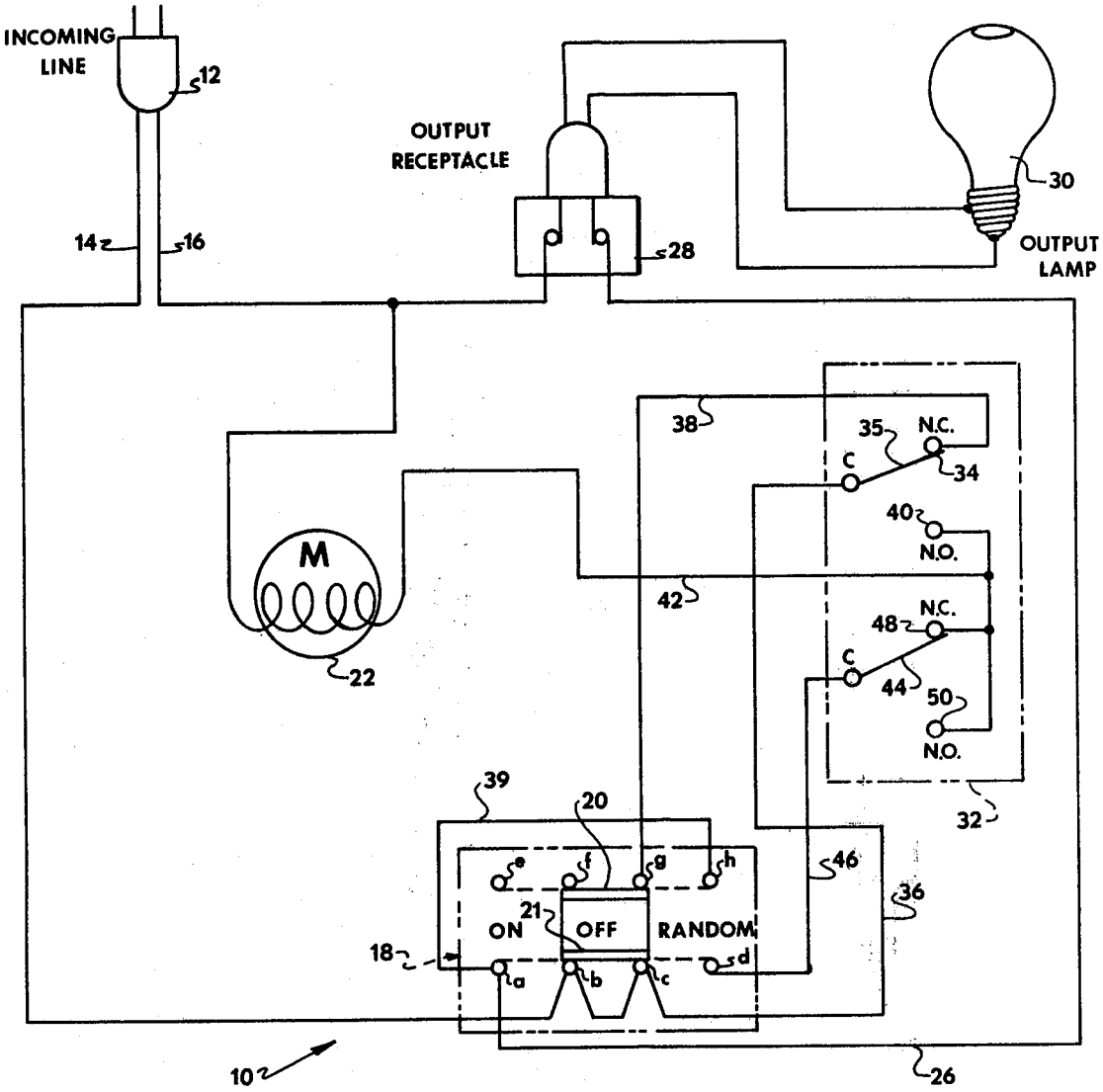
FIG. 1 is a diagrammatic wiring diagram of the circuit of the random timer device of the invention.

FIG. 1 shows a suitable diagrammatic circuit for the random timer device of the invention and wherein this circuit is indicated as a whole by the numeral 10. It includes a conventional power supply plug 12 for engaging a power outlet to supply power to leads 14 and 16. Lead 14 connects to a multi-contact switch 18 that has on, off and "random" switch positions, as indicated. This switch has contacts a, b, and c through h provided therein and a pair of slide bars 20 and 21 are present in the switch for moving or being controlled so as to connect the power supply to the operative portion of the circuit 10, or to shut it off, as desired.

When the switch 18 is in its "on" position, power flows directly through a line 26 to an output receptacle 28 that connects to an output indicator, such as a lamp 30. However, when the system is on its "random" setup, power then reaches this output receptacle 28 through a multi-contact switch or other similar control device 32. In this particular embodiment of the invention, the switch 32 is shown as having a normally closed first position or terminal 34 that is powered from the switch 18 by a lead 36 and a switch arm 35. The terminal 34 in turn connects through a lead 38 back to the switch 18 and from it by a connector 39, back to the lead 26 for power supply to the outlet 28. However, when the operating conditions are such as described hereinafter, and the switch arm 35 is moved to its second position, it deenergizes the output 30 and may close a terminal or contact 40 that is normally open in the switch. Power is maintained to the motor 22 by a lead 42 usually connected to contact 40, but the circuit to the outlet receptacle 28 is interrupted whereby the motor will operate and continue to drive the timing elements for other operating conditions and to maintain the desired random energization of the output receptacle 28. Such motor operation also occurs when the switch 18 is in its "off" position, as long as the terminal 40 is closed.

The motor 22 preferably has power supplied thereto, normally, by a second switch in the control device 32. Such switch has a control arm 44 that is continuously connected to a lead 46 from random contact d of the switch 18. The control arm 44 has only two positions and it engages contact 48 in one position and contact 50 in its second position. Both of such contacts 48 and 50 connect to lead 42 to energize the motor 22, but to interrupt power supply thereto each time the second switch (arm 44) is changed in position.

Naturally, in the "on" position of the switch 18, the output receptacle 28 has power supplied thereto at all times.

Other figures of the drawings, including FIGS. 2 through 6, show details of the mechanical embodiment of the apparatus diagrammatically shown in FIG. 1. Corresponding members from FIG. 1 are referred to with corresponding numbers in the other figures, but with the suffix a being added so that comparison can be made between these corresponding elements. The multi-contact switch 18 in these figures is indicated as a whole by the numeral 60 to distinguish from the use of the terminal numeral 18*a* previously referred to herein. The motor 22*a* is indicated and it is controlled in its operation by two control switches 62 and 64, as well as by the multi-contact switch 60.

Figure 2:
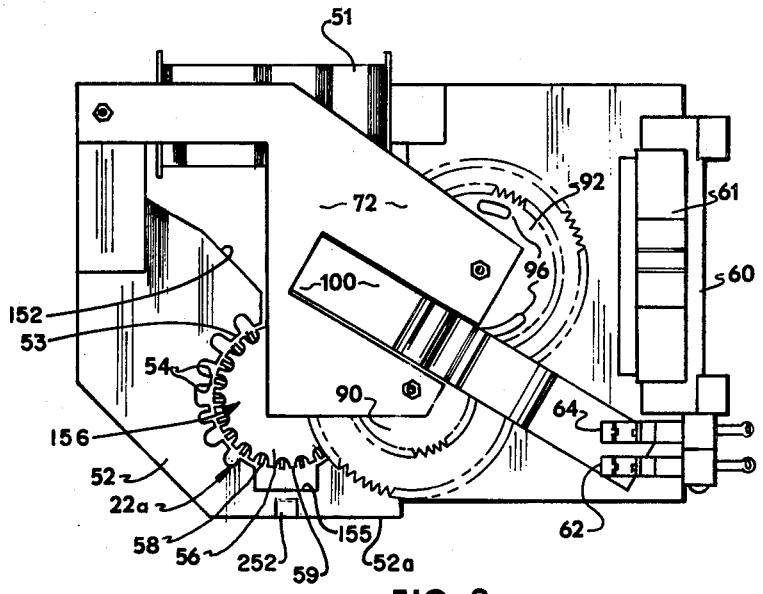
FIG. 2 is a top plan of the timer device of the invention.

The motor 22*a* preferably is a low cost, simply constructed, bi-directional AC motor formed from a flat metal stator plate 52 having a circular hole therein with pole projections 54 around the periphery of the hole. A flat plate magnet (not shown), with poles on its top and bottom facts, is present in a hollow metal disc 56 positioned in the hole in the plate 52, and it has interlocking pole projections 58 and 59 formed on the two fact plates forming the disc 56. These pole projections 58 and 59, on the different plates, are turned over toward the other plate in circumferentially spaced relation (FIG. 2). The flat magnet is between and parallel to the face plates. The stator plate 52 is energized by coil 51 that extends around an arm of the plate and which coil connects to the power supply lead 42 (not shown in FIG. 2).

More specifically, the motor 22*a* has an output shaft driving an output gear connecting to a suitable gear train means to control and regulate drive for two dissimilar timer means provided in the apparatus.

In the actual random timer unit 10, any suitable outer frame means 70 is provided, and such frame 70 usually is made from an insulating material. The operative portion of the timer mounted in the frame 70 includes an upper support plate 72, made from plastic material that is mounted on the stator plate 52 as by an insulating column 74 extending vertically of the frame 70 as shown. The stator plate 52 is supported in spaced relationship to the frame 70, as by short support legs 76 connected by an insulating bar 78 that is positioned under the stator plate 52. Such bar 78 also serves as a support or journal for the end of vertically extending operative shafts provided in the timer apparatus.

Figure 3:
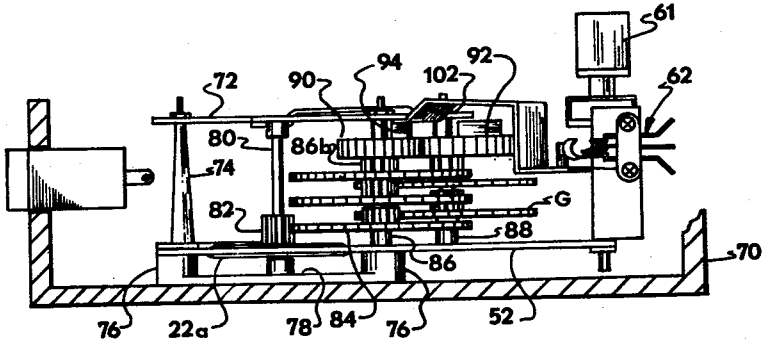
FIG. 3 is a vertical view, partly in section, through the random timer device embodying the principals of the invention, with a portion of the cover means therefore removed.

FIGS. 2 and 3 show the control or main switch 60 and a slide control bar 61 therefore.

Regarding the two operative drive circuits provided for the two different timing and cam controls in the apparatus, the motor 22*a* has an output shaft 80, with gear 82 thereon, journalled in and extending between the support plate 72 and the lower support block 78, which shaft also carries the motor rotor disc 56 thereon. The output gear 82 is a small diameter gear and it engages and drives a relatively large diameter gear 84 mounted on one stationary support or output shaft 86 operatively positioned on the support plate 72 and extending down and being supported on the stator plate 52 or extending therethrough and engaging the support block 76 thereunder. A second stationary support or output shaft 88 also extends vertically of the timer apparatus and parallel to the first output shaft and a plurality of large and small diameter gears are operatively carried on these shafts for operatively interconnecting the shafts to greatly reduce the speed of drive of the gears as one extends vertically upwardly in the stack of gears mounted on each of the supports or output shafts. The output shaft 86 has an upper smaller diameter output gear 90 thereon and a larger diameter output gear 92 is operatively journalled on the second shaft 88. These gears 90, 92 engage each other to be driven in correlated speed relationship with drive reaching the gear 90, from a pinion gear positioned therebelow, to which the output gear 90 is secured.

In order to obtain the desired random control action, each of the output gears 90 and 92 has one or more control cams or cam flanges provided thereon. Hence, control cam 94 extends out from the first output gear 90, and a plurality of control cams 96 are provided in irregular circumferentially spaced relationship protruding from the second output gear 92. It will be noted that these gears 90 and 92 are positioned in the same horizontal plane and that the cams 94 and 96 are adjacent the periphery of the gears and, hence, are in adjacent relationship with each other as the gears revolve. Such adjacent relationship is on a line substantially tangent to the interengaged gears 90 and 92.

As a feature of the invention, the time 10 is operated by minimal power and special gears and supports aid in achieving such goal.

Figure 4:
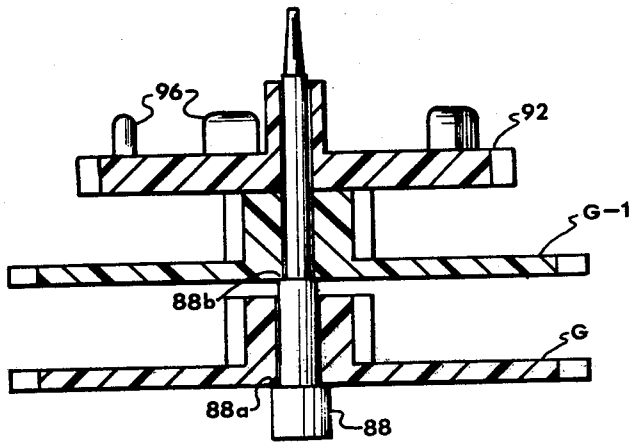
FIG. 4 is a fragmentary enlarged vertical section taken on one gear support member.

FIG. 4 shows the construction of the supports or shafts 86 and 88 and it indicates how a support shoulder 88*a* is provided adjacent the lower portion of the shaft 88 and its flat surface journals the lowermost large diameter drive gear G thereon. Each large gear normally has a drive pinion formed therewith to engage a companion gear on the other shaft to engage and drive it. A second large gear G-1 above the gear G is suitably journalled on a second hub or shoulder 88b formed intermediate the ends of the shaft above shoulder 88a. The output gear 92 is rotatably supported on a flat upper surface of the drive pinion of the gear G-1. Gears on the shaft 86 also are supported on shoulders thereon. The other output gear 90 is directly supported on its adjacent lower pinion gear 86b and it would be suitably engaged with or secured to such lower gear to rotate therewith and be driven thereby. By this action, all of these interconnected gears in the gear train can be made from a suitable low friction plastic material, such as nylon or the like, and low weight gears are present and are readily supported on each other and driven by minimal forces for the control action, as desired.

Figure 5:
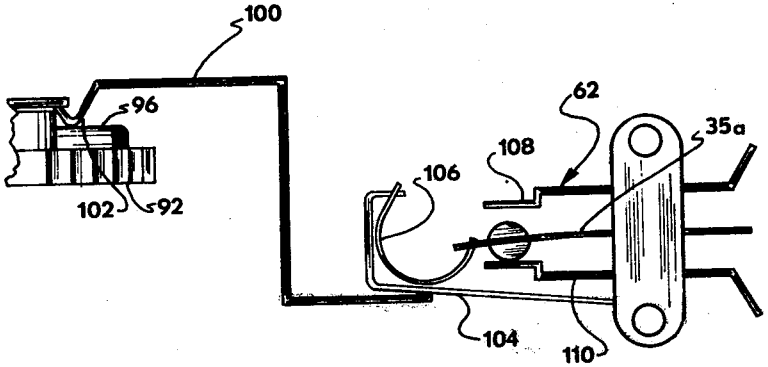
FIG. 5 is a fragmentary enlarged view of part of the control switches on the timer of FIG. 2.

Control action in the unit is provided by a control member or device 100 comprising a leaf spring that has its base end secured to the support plate 72 and with the spring protruding therefrom along a line tangent to the output gears 90 and 92 and having downwardly offset section 102 extending transversely thereof and being so positioned vertically as to be in resilient sliding engagement with the upper surface of these output gears, and with the output cams 94 and 96 individually engaging this offset 102 to raise the cantilevered free end of the spring 100 for a control action on the control switch 62 and reverse, or power interrupter switch 64. FIG. 5 shows the details of the switch 62 wherein switch arm 35a is resilient and is operatively positioned in the unit by a suitable member mounting it on the frame in insulated relation thereto. The operative arm 35a has a specifically contoured control spring 104 mounted in the switch and extending in substantially parallel relation to the arm 35a, but extending axially therebeyond to overlap the free end of the spring 100 and engage the same. A U-shaped connector spring 106 extends between an upper free end of the spring 104 and the free end of the spring or control arm 35a so that when one lifts the control spring 100 it lifts the springs 104 and 106 to reverse the position of the contact arm 35a and to move it from engaging with a lower contact arm 110 over to engage with an upper contact arm 108. This is equivalent to the contacts 34 and 40, respectively, as shown in FIG. 1 to provide the action indicated in the sketch of FIG. 1.

Likewise reverse switch 64 is operated by the arm 100 and the switch 64 is made like the switch 62. The switch 64 compares to the arm 44 and associated means of FIG. 1.

The frame 70 is removed in FIG. 2 for clarity. Wires connecting to the timer are not shown in FIGS. 2 through 5.

The lightweight gears G, G-1, etc. are made of low friction plastic and move easily relative to each other or to the support shaft or rod 86 or 88 on which they are supported. The large gears may each have a separate shoulder for support or two gears can be supported one on top of the other from one shoulder as per FIG. 4. The drive gear 90 is suitably mechanically secured to or interlocked with the gear 86b to rotate therewith.

The switch 64 may be omitted in some instances as well as the arm 44 and its contacts. Then the contact 34 could connect to the lead 42 for initial power supply to the motor, and contact 40 would also connect to lead 42.

It will be understood that the leaf spring section 102 normally slidably bears on the upper surfaces of the gears 90 and 92 but as any one of the cam flanges 94 or 96 is moved to engage the section 102, the cantilevered end of the spring arm 100 is moved upwardly to change the normally closed position of the arm 35a. When the arm 100 is lowered by the cam flange, the spring arm 35 then returns to its normal closed position as in FIG. 5.

It will be noted that a moving flux field is created by the pole projections 54 by coil 51, and this causes the rotor or disc 56 to rotate to operate the motor 22a. The motor is bi-directional in rotation and the rotational direction is determined by the one-half cycle first incident to the motor. The gear train means and timer means likewise are bi-directional in rotation.

FIG. 2 best shows that the stator plate 52 has a substantially annular recess 53 in an edge 152 thereof and in which the rotor assembly means 156 is rotatably positioned.

Magnetic flux produced by the energizing of the coil 51 must flow through the motor rotor means 156 and its air gap or flow through the plate 52 around the recess 53 and pass through a relatively narrow control section 52a of the plate 52 formed at one margin of the recess 53. The area of the plate at this portion thereof is further restricted by the provision of cut-out section 55 at one peripheral portion of the recess 53 to further restrict the area of the plate at the control section 52a. This area of the plate is calculated to be of such a size in relation to the strength of magnetic flux generated by the coil 51 on the plate 52 that all of the magnetic flux created by the winding 51 could pass through the section 52a if we provided enough ferrous material in that area to accommodate such flux. By making the area narrow, however, it in general accommodates the magnetic flux only upto the saturation point of the metal and then the remaining magnetic flux is forced to take the less desirable route which is through the rotor assembly means 156. The magnetic path through the rotor assembly is obviously less attractive to the flux because of the air gap which exists all around this rotor assembly. Thus, I control the flow of flux through the stator plate and particularly through the section 52a and how much flux is forced to flow through the rotor assembly means 156. The motor would have little or no torque if flux does not move from the stator plate to the rotor assembly and through it back to the stator. In effect, the plate section 52a provides a shunt path for the magnetic flux in relation to the rotor assembly and its volume is controlled.

Figure 7:
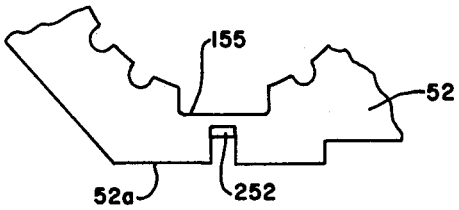
FIG. 7 is a fragmentary plan of a portion of the stator plate for use with 60 cycle current.
Figure 6:
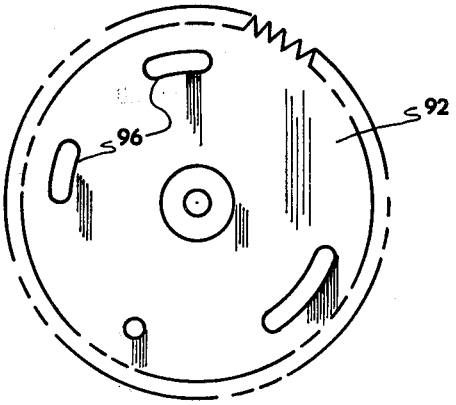
FIG. 6 is a fragmentary diagrammatic plan view of one of the output timer gear and cam units of the invention.

It has been found that the stator plate as shown is adapted to function effectively under 50 cycle exitation power supply for the coil 51 and acceptable heat and torque are provided for the motor in its operative assembly as shown. However, when a 60 cycle motor is used on 50 cycle power, the motor windings will overheat due to the lower frequency supplied whereas if a 50 cycle motor design is connected to a 60 cycle power source, the motor suffers a decrease in torque. Hence, frequently entirely different motors are supplied for use in the different power cycle countries in the world. By the present invention, however, the stator plate 52 is provided with the small tab 252 that can be bent outwardly from the plane of the stator plate 52, or can be permitted to remain in the plane. When in the plane of the stator plate, the motor is effective for the 50 cycle power supply use. By just moving this small tab, however, out to a position substantially perpendicular to the plane of the stator plate as shown in FIG. 7, the flux path has been so changed that the motor can be used efficiently with 60 cycle power supply and not overheat and still provide proper torque for motor operation. Bending out such little tab has the obvious effect of reducing the amount of magnetic flux that can flow through this section 52*a* and causes more of the flux to be diverted through the rotor assembly 56.

From the foregoing, it is seen that a novel, irregular timer apparatus has been provided. And, the objects of the invention have been achieved.

While one complete embodiment of the invention has been disclosed herein, it will be appreciated that modification of this particular embodiment of the invention may be resorted to without departing from the scope of the invention.

What is claimed is:

1. A timer device comprising a bi-directional rotation AC electric drive motor, an output means, a control switch connectable to an AC power source, and a power circuit connecting said control switch, drive motor, and said output means; two dissimilar timing elements operably connected to and driven by said drive motor, said power circuit including a multi-contact switch having a member movable from a normally closed terminal first position to a second position, power being supplied to said output means by said switch first position, and characterized by a control member operably connected to said multi-contact switch to move same from its normally closed first position to an actuated second position, a connector and control means engageable individually with said timing elements to actuate said control member to move said multi-contact switch to its actuated second position to interrupt power flow to said output means on an irregular basis, and a switch means in a power circuit for said motor operably connected to said control member to be moved from a circuit closing position through a circuit opening position and to a circuit closing position with each movement of said member from its first to its second position.

2. A timer device as in claim 1, where said connector and control means includes a spring arm movable by said timing elements and engaging both said multi-contact switch and switch means, said drive motor and timing elements both being rotational in either direction.

3. A timer device as in claim 2, where said spring arm is intermittently engaged and released by one or both of said timing elements and when released it releases said multi-contact switch and said switch means, and said drive motor will rotate in a direction controlled by the one-half power cycle first incident to said drive motor.

4. A timer device comprising:

a drive motor, an output means, a control switch connectable to a power source, a power circuit connecting said control switch, drive motor, and said output means, gear train means coupled to and driven by said drive motor and including a pair of control rods each mounting gears thereon that are driven at different speeds, said power circuit including a multi-contact switch have an arm movable from a normally closed first position to a normally open terminal second position to close the same, and characterized by a resilient cantilever mounted control member operably connected to said multi-contact switch to move said arm from its normally closed first position to a second position, said first position being connected to said output means, a rotary cam means operably positioned on each of said control rods and engaging and being driven by said gear train means for individually or jointly temporarily engaging said control member to move it to a position to move said arm of said switch to interrupt power flow to said output means on an irregular basis, and a switch in said power circuit of said drive motor and opened by said control member with each actuation thereof by either of said cam means.

5. A timer as in claim 4 where said control rods are normally positioned on vertical axes, a plurality of horizontally positioned gears are operatively and rotatably positioned on each of said rods and are maintained in predetermined vertical relation by supporting some of said gears on shoulers formed on said rods.

6. A timer as in claim 5, where said gears and said rods are formed from low friction plastic material and flat contact areas are present on said gears and/or on said shoulders for rotation of said gears in relation to each other or to said shoulders.

7. A timer as in claim 4, where said drive motor is an AC bi-directional drive motor formed from a stator of flat metal plate-shape having a rotor receiving hole therein, pole projections being formed on the wall of said hole, a disc-shape rotor with a permanent magnet therein is positioned in said hole and a motor drive shaft engages said rotor and extends therefrom to engage said gear train means.

8. A timer device comprising a frame means, a drive motor, an output means, a power control switch connectable to a power source, and a power circuit connecting said control switch, drive motor, and said output means, and characterized by two dissimilar timing elements driven by said driven motor each including an output gear and a plurality of individual cam means thereon;

said power circuit including a switch means having a member movable from a normally closed terminal first position to a second position, said output means being energized by said switch means only when in said first position a control member operably connected to said switch means to move same from its normally closed position to its actuated second position, connector and control means engageable individually and operably with said timing elements to move said control member to open said switch means and interrupt power flow to said output means on an irregular basis, which last named means includes a spring arm having one end operably engaged with said frame means, said cam means being directly engageable with a free end portion of said spring arm which engages said switch means to move it temporarily to its second position when any one of said cam means engage said spring arm, and a second switch is provided in said drive motor circuit to interrupt drive of the same with each opening of said power circuit to provide another variable factor in the operation of said timer, said drive motor being a bi-directional AC drive motor.

9. A timer as in claim 8, where said AC bi-directional drive motor includes a stator of flat metal plate-shape having a rotor receiving recess therein, an energizing coil is associated with said stator and flux therefrom seeks to flow through said stator around said recess, pole projections being formed on the wall of said hole, a disc-shape rotor with a permanent magnet therein is positioned in said recess, and a limited volumn metal control section is formed in one edge portion of said recess.

10. A timer as in claim 9, where a tab is formed in an edge of said metal control section and the operative power cycle for said coil can be varied when said tab is bent out of a plane defined by said stator.

* * * * *